United States Patent [19]

Ofusa

[11] 4,215,729

[45] Aug. 5, 1980

[54] WOVEN FASTENER STRINGER

[75] Inventor: Masaatsu Ofusa, Kurobe, Japan

[73] Assignee: Yoshida Kogyo K.K., Tokyo, Japan

[21] Appl. No.: 973,538

[22] Filed: Dec. 26, 1978

[30] Foreign Application Priority Data

Dec. 29, 1977 [JP] Japan ..... 52-5390

[51] Int. Cl.[2] ..... A44B 19/12

[52] U.S. Cl. ..... 139/384 B; 24/205.16 C

[58] Field of Search ..... 139/384 B; 24/205.13 C, 24/205.16 C

[56] References Cited

U.S. PATENT DOCUMENTS

| | | | |
|---|---|---|---|
| 3,022,803 | 2/1962 | Berberich | 139/384 B |
| 3,266,114 | 8/1966 | Gerlach et al. | 139/384 B |
| 3,524,479 | 8/1970 | Burbank | 139/384 B |
| 4,011,895 | 3/1977 | Negro | 24/205.16 C |

FOREIGN PATENT DOCUMENTS

| | | | |
|---|---|---|---|
| 2333152 | 1/1975 | Fed. Rep. of Germany | 139/384 B |

*Primary Examiner*—Henry Jaudon

*Attorney, Agent, or Firm*—Bucknam and Archer

[57] ABSTRACT

A woven fastener stringer has a row of successively interconnected coupling loops having a head, an upper leg, a lower leg and a heel. The row of loops is secured to a longitudinal edge of a stringer tape by a first group of warp threads consisting of an exterior thread extending over the upper legs and an interior thread extending under the upper legs and a second group of warp threads consisting of an exterior thread extending under the lower legs and an interior thread extending over the lower legs. Both first and second groups of threads are interwoven with the portions of a continuous foundation weft thread which lie in double picks in the region of a tunnel.

5 Claims, 6 Drawing Figures

WOVEN FASTENER STRINGER

BACKGROUND OF THE INVENTION

1. Field of the Invention

This invention relates to a slide fastener, and more particularly to a fastener stringer having a continuous plastic filament spirally formed and woven into an edge of a stringer tape during the weaving thereof by a needle loom.

2. Prior Art

There have been proposed a number of slide fasteners or zippers of the type described, which comprise a woven stringer tape and a plastic filament woven into a longitudinal edge of the tape, the filament being usually formed into a helical coil structure consisting of a succession of loops or elongated convolutions each having a coupling head, an upper and a lower leg and a connecting portion.

There are known two typical methods of making woven fastener stringers; one such method is to weave a continuous linear filament on a shuttle loom in a manner similar to a weft thread and formed, in the course of weaving, into a spirally-arranged interlocking structure, and the other method is to preform filament into a spiral or coil structure and interweave the same as the warp along an edge of the tape with double picks of a continuous weft thread on a needle loom.

While the shuttle weaving is advantageous in that the filament can be secured to the tape with a group of less bulky binding threads, the shuttle itself is necessarily small for handling fastener stringers and hence not suitable for producing an elongated, substantially endless slide fastener chain with reasonable speed. This drawback is eliminated by the needle loom operation which has however a difficulty in that the weave system which secures the filament to the tape becomes objectionally bulky and presents itself to be an obstacle to the movement of a slider, resulting in torn or worn tape threads.

SUMMARY OF THE INVENTION

According to the invention, there is provided, a woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section, each of said loops having a coupling head at one end thereof, an upper leg and a lower leg extending from said head in a common direction and a heel portion remote from said head connected to a next adjacent one of said successive loops; a first binding warp system consisting of a plurality of exterior warp threads extending in parallel longitudinally of said tape and overlying the upper legs of successive ones of said elongated loops, and an interior warp thread extending longitudinally of said tape and underlying the upper legs of said loops; and a second binding warp system consisting of a plurality of exterior warp threads extending in parallel longitudinally of said tape and underlying the lower legs of successive ones of said loops and an interior warp thread extending longitudinally of said tape and overlying the lower legs of said loops, said first and second binding warp systems being interwoven in the spaces between each adjacent pair of said loops with the portions of said foundation weft thread which are laid on double picks into said woven filament section.

It is therefore an object of the present invention to provide a stringer for a slide fastener which has a row of successively interconnected elongated loops or convolutions formed from a plastic filament and woven into a stringer tape or a needle loom, the row of elongated loops being stably secured in place to maintain the proper alignment and spacing of the interconnected loops.

Another object of the invention is to provide such a fastener stringer which has a row of elongated loops secured to the tape with a minimum of threads exposed over the upper legs of the loops so that the loops present a relatively low profile to permit smooth movement of a slider therealong.

Other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENTS

Figure 1:
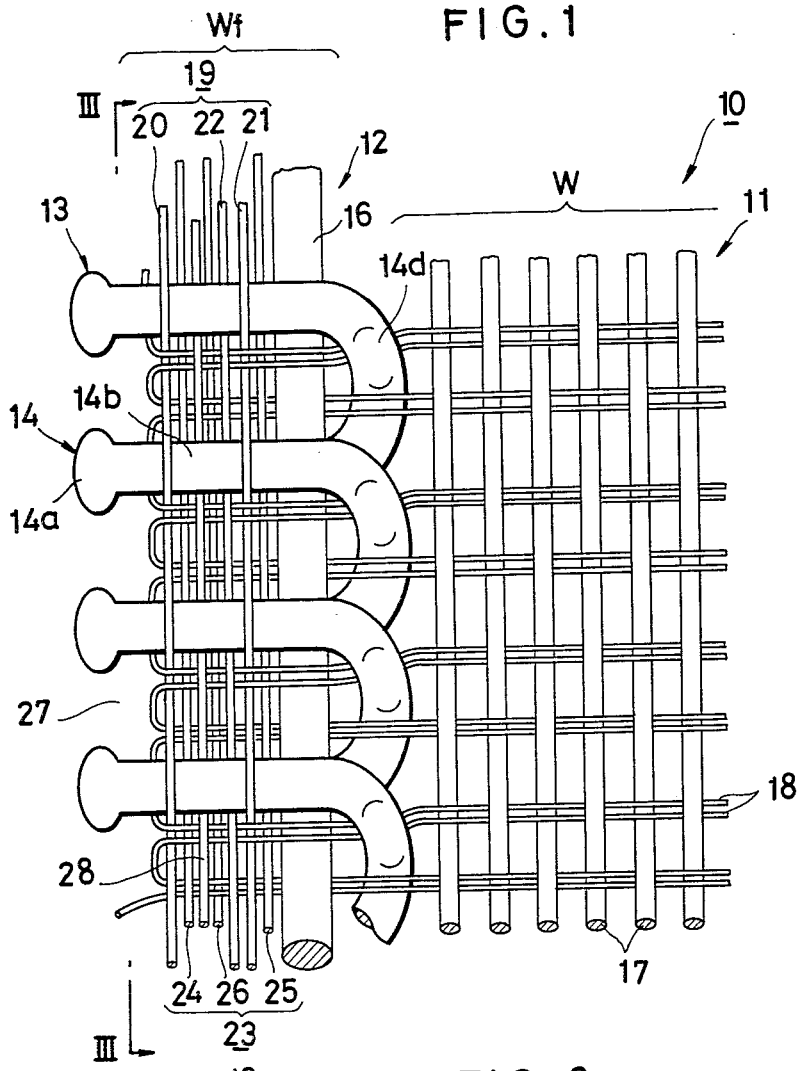
FIG. 1 is a plan view on enlarged scale of a portion of one of two identical fastener stringers provided in accordance with the invention.

A fastener stringer generally designated 10 constitutes one part of a pair or two identical stringers for a slide fastener. The stringer 10 consists of a generally flat web section W defining a major dimension of a woven tape 11 and a woven filament section $W_f$ defining a longitudinal edge portion 12 into which a filament of plastic material 13 is woven in the form of a row of successive elongated loops or convolutions which serves as a "coupling fastener element".

Each loop or elongated convolution 14 in the filament 13 has a coupling head **14*a* at one end thereof, an upper leg 14*b* and a lower leg 14*c* extending from the head 14*a* in a common direction and a heel portion 14*d* remote from the head 14*a* connected to a next adjacent one of the successive loops 14. The coupling head 14*a* is dimensioned to releasably couple with a corresponding head of a loop 14 on a mating stringer to open and close the fastener in the well known manner. The upper and lower legs 14*b* and 14*c* are spaced apart in substantially superimposed relation to each other as shown in FIG. 1 and define therebetween a longitudinally extending "tunnel" or hollow conduit 15 through which a reinforcing stringer, cord or core 16** is inserted.

The web section W of the tape 11 may be of any known design having foundation warp threads 17 and foundation weft thread 18 interwoven in a variety of patterns, which will require no further explanation as this has no direct bearing upon the invention.

The term "filament woven section $W_f$" is used to define a longitudinal edge portion of the tape 11 into which the filament 13 serving as a coupling element for a slide fastener is woven.

Figure 2:
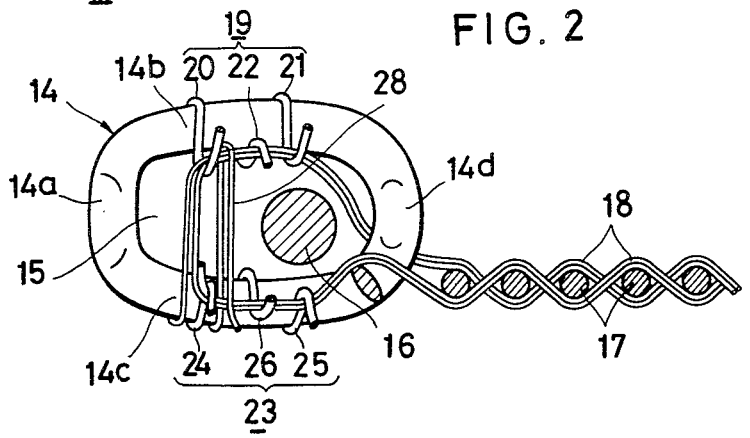
FIG. 2 is a diagrammatic, end elevational view of the fastener stringer shown in FIG. 1.
Figure 3:
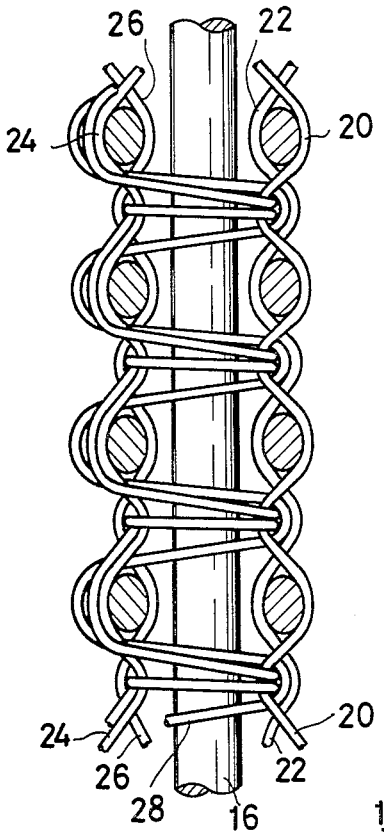
FIG. 3 is a cross-sectional view taken along the line III—III of FIG. 1.
Figure 4:
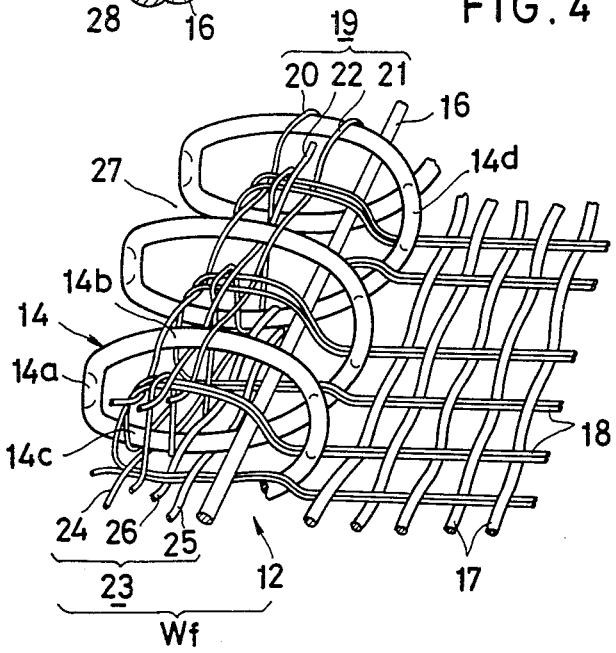
FIG. 4 is a diagrammatic perspective view of the stringer shown in FIG. 1.

In the filament woven section $W_f$ of the stringer tape 11, there is provided a first binding warp system 19 consisting of a plurality of exterior warp threads 20, 21 which extend in parallel longitudinally of the stringer tape 11 and overlie the upper legs **14*b* of successive ones of the elongated loops 14 and an interior warp thread 22 which extends longitudinally between the exterior warp threads 20, 21 and underlies the upper legs 14*b* of the elongated loops 14. A second binding warp system 23 consists of a plurality of exterior binding warp threads 24, 25 extending in parallel longitudinally of the stringer tapes 11 and underlying the lower legs 14*c* of successive ones of the elongated loops 14 and an interior warp thread 26 extending longitudinally between the exterior warp threads 24, 25 and overlies the lower legs 14*c* of the elongated loops 14. The first and second binding warp systems 19 and 23 are interwoven with the portions of the continuous foundation weft thread 18 which lie in double picks in the region of the longitudinally extending tunnel 15. More specifically, the first binding warp system 19 is interwoven with the foundation weft thread 18 in the spaces between each adjacent pair of loops 14 or in each of successive ones of "inter-leg" spaces 27 and at a position such that the exterior warp threads 20, 21 are crossed in spaced relation with the interior warp thread 22 along a longitudinal axis defined by successive upper legs 14*b* with the threads 20, 21 engaging substantially the entire outer surface of the upper leg 14*b* of each loop 14 and the thread 22 engaging substantially the entire inner surface of the upper leg 14*b*, respectively, as better shown in FIG. 3. In a manner similar to the first weave system 19, the second binding warp system 23 is interwoven with the foundation weft thread 18 in each of successive ones of "inter-leg" spaces 27, so that the exterior warp threads 24, 25 are crossed with the interior warp thread 26 along a longitudinal axis defined by successive lower legs 14*c*, with the threads 24, 25 engaging substantially the entire outer surface of the lower leg 14*c* of each loop 14 and the thread 26 engaging substantially the entire inner surface of the lower leg 14*c*, respectively. This binding structure ensures firm an integral fixation of individual loops 14 to the woven filament section $W_f$ of the stringer tape 11 and maintains the proper alignment and loop-to-loop spacing of the row of loops 14 against external stresses. There is provided a retainer warp thread 28 which extends longitudinally of the stringer tape 11 and underlies the lower legs 14*c* of successive loops 14. This retainer thread 28 rises in each of successive ones of "inter-leg" spaces 27 and is interwoven with the weft thread 18 in the woven filament section $W_f$ of the tape 11 so that the thread 28 retains the portions of the weft thread 18 in place which are interconnected with the first and second binding warp systems 19 and 23, as shown in FIGS. 2–4**.

Figure 5:
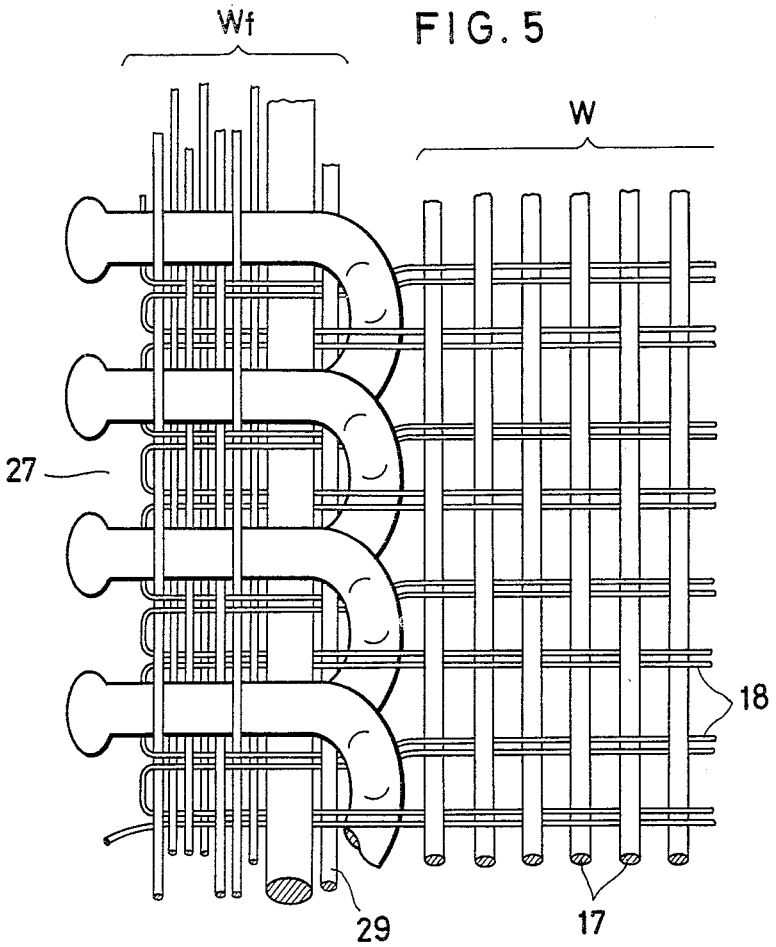
FIG. 5 is a plan view similar to FIG. 1 but showing a modified form of woven fastener stringers.
Figure 6:
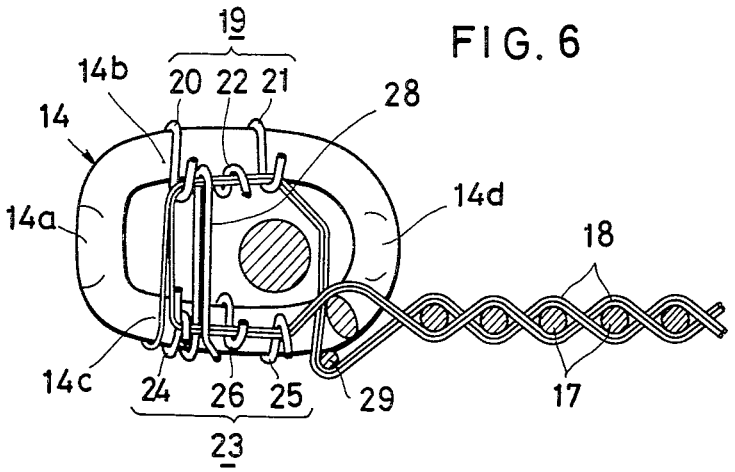
FIG. 6 is a diagrammatic, end elevational view of the fastener stringer shown in FIG. 5.

A modified form of woven fastener stringer 10 is shown in FIGS. 5 and 6, which is the same in all structural details except that there is provided a border warp thread 29 extending longitudinally of the stringer tape 11 and interwoven with the foundation weft thread 18 in each "inter-leg" space 27 at a position underlying the portion of the lower leg **14*c* which emerges into the heel portion 14*d*. The border warp thread 29 serves on one hand to define the border-line between the web section W and the woven filament section $W_f$ of the tape 11 and on the other hand to prevent the web section W from getting displaced upwardly relative to the row of loops 14**.

Since the exterior warp threads 20, 21 are the only threads that are exposed on the upper legs **14*b* of the loops 14, the resulting woven filament section $W_f$ including the row of loops 14** has a relatively low profile and allows a slider (not shown) to move therealong smoothly without fear of damaging the tape threads.

The invention should not be limited to the precise form and construction described and illustrated, but changes and further modifications may be made therein as appear obvious to one skilled in the art, without departing from the scope of the appended claims.

What is claimed is:

1. A woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section, each of said loops having a coupling head at one end thereof, an upper leg and a lower leg extending from said head in a common direction and a heel portion remote from said head connected to a next adjacent one of said successive loops; a first binding warp system consisting of a plurality of exterior warp threads extending in parallel longitudinally of said tape and overlying the upper legs of successive ones of said elongated loops, and an interior warp thread extending longitudinally of said tape and underlying the upper legs of said loops; and a second binding warp system consisting of a plurality of exterior warp threads extending in parallel longitudinally of said tape and underlying the lower legs of successive ones of said loops and an interior warp thread extending longitudinally of said tape and overlying the lower legs of said loops, said first and second binding warp systems being interwoven in the spaces between each adjacent pair of said loops with the portions of said foundation weft thread which are laid in double picks into said woven filament section.

2. A woven fastener stringer as defined in claim 1 wherein the exterior warp threads and the interior warp thread in said first binding warp system are crossed in spaced relation with each other along a longitudinal axis defined by successive upper legs of said loops, said exterior threads engaging substantially the entire outer surface of said upper legs and said interior thread engaging substantially the entire inner surface of said upper legs, respectively.

3. A woven fastener stringer as defined in claim 1 or 2, including a retainer warp thread extending longitudinally of said tape and underlying the lower legs of said loops and rising in the spaces between each adjacent pair of said loops to interweave with said foundation weft thread.

4. A woven fastener stringer as defined in claim 1 or 2, wherein said interior warp thread in each of said first and second systems is interposed between the respective exterior warp threads.

5. A woven fastener stringer as defined in claim 1 or 2, further including a border warp thread extending longitudinally of said tape and interwoven with said foundation weft thread in the spaces between each adjacent pair of said loops at a position underlying the portion of said lower leg which emerges into said heel portion.

* * * * *